US006199877B1

(12) United States Patent
Shockley

(10) Patent No.: US 6,199,877 B1
(45) Date of Patent: Mar. 13, 2001

(54) TRANSFORMABLE MECHANIC'S CREEPER

(76) Inventor: Troy E. Shockley, 105 Trails End, Greenville, SC (US) 29607

( * ) Notice: Subject to any disclaimer, the term of this patent is extended or adjusted under 35 U.S.C. 154(b) by 0 days.

(21) Appl. No.: 09/632,825

(22) Filed: Aug. 7, 2000

(51) Int. Cl.[7] ..... B25H 5/00
(52) U.S. Cl. ..... 280/32.6
(58) Field of Search ..... 280/32.6, 30; 297/16.1, 297/16.2, 19; 248/129

(56) References Cited

U.S. PATENT DOCUMENTS

| | | | | |
|---|---|---|---|---|
| Re. 35,732 | | 2/1998 | Shockley | 280/32.6 |
| D. 285,018 | | 8/1986 | Quinonez | D34/23 |
| D. 289,815 | | 5/1987 | Quinonez | D34/23 |
| 1,327,103 | | 1/1920 | Knowles . | |
| 2,124,389 | | 7/1938 | Woelfer, Jr. | 280/61.5 |
| 2,595,783 | | 5/1952 | Griffin | 280/61.5 |
| 2,595,784 | | 5/1952 | Griffin | 280/61.5 |
| 2,611,417 | | 9/1952 | Henry et al. | 155/41 |
| 2,668,964 | | 2/1954 | Simmons | 5/327 |
| 2,692,636 | | 10/1954 | Morrison | 155/41 |
| 2,804,127 | | 8/1957 | Whittingham | 155/177 |
| 2,843,391 | | 7/1958 | Pelletier | 280/32.6 |
| 4,025,106 | | 5/1977 | Kyte | 297/16 |
| 4,471,969 | | 9/1984 | Zabala et al. | 280/30 |
| 4,580,799 | | 4/1986 | Quinonez | 280/32.6 |
| 4,895,380 | * | 1/1990 | Brooks | 280/32.6 |
| 4,957,302 | | 9/1990 | Maxwell | 280/32.6 |
| 5,072,955 | | 12/1991 | Holland et al. | 280/32.5 |
| 5,451,068 | * | 9/1995 | Shockley | 280/32.6 |
| 5,472,219 | * | 12/1995 | Fekstrum | 280/32.6 |
| 5,577,744 | * | 11/1996 | Parks | 280/32.6 |
| 5,611,552 | * | 3/1997 | Miles et al. | 280/32.6 |
| 5,707,067 | | 1/1998 | Smith | 280/32.6 |
| 5,895,062 | * | 4/1999 | Miles et al. | 280/32.6 |
| 5,947,489 | * | 9/1999 | Tucker | 280/32.6 |
| 6,010,187 | * | 1/2000 | Dallas et al. | 280/32.6 |

FOREIGN PATENT DOCUMENTS

| | | | |
|---|---|---|---|
| 283330 | 1/1928 | (GB) . | |
| 2251828 | 8/1992 | (GB) | B25H/5/00 |
| WO88/09707 * | 12/1988 | (WO) . | |

* cited by examiner

*Primary Examiner*—Richard M. Camby
(74) *Attorney, Agent, or Firm*—Flint & Kim, P.A.

(57) ABSTRACT

A transformable mechanics creeper is disclosed having an elongated creeper frame which includes a base assembly and a seat assembly interconnected by an interlinking connector frame pivotally connected to the base assembly and the seat assembly. The interlinking connector frame has a first pivot position in which the seat assembly is positioned generally in horizontal alignment with the base assembly for defining a creeper position, and a second pivot position in which the seat assembly is positioned generally in vertical alignment with the base assembly to define a seating position wherein the seat assembly and the base assembly support a worker in an upright seating position. A slidable roller frame supports the seat assembly and provides mobility in the creeper position. In the seat position, the roller frame may be retracted for a small footprint or extended for increased support or a utility shelf. An extendable roller frame assembly slidably carried by said creeper frame having a retracted position when the interlinking connector is in said first pivotal position defining said seat position. The roller frame assembly has an extended position when said interlinking connector is in said second pivotal position for supporting said seat assembly in said creeper position. At least one wheel is carried by said roller frame assembly providing mobility for said creeper in said creeper position. The roller frame assembly may also be maintained in the extended configuration to provide a shelf for a tool tray and the like when the creeper is in the seat position.

17 Claims, 5 Drawing Sheets

TRANSFORMABLE MECHANIC'S CREEPER

BACKGROUND OF THE INVENTION

This invention relates to a mechanic's creeper, and more particularly to a mechanic's creeper which is transformable between a horizontal creeper and an upright seat.

During the performance of maintenance on automobiles and the like, it is often required that the mechanic be able to work under the chassis of the automobile. In the past, it has been known to use flat surfaces on wheels, known as creepers, enabling the mechanic to lie in a supine position and survey and work underneath the automobile. Additionally, it is known to use work bays where cars may be placed on hydraulic lifts and elevated to a position above an upright mechanic. Furthermore, mechanics sometimes use seats when working about the exterior of an automobile.

The problem has arisen in that to work on an automobile, the mechanic uses a creeper for work underneath the automobile's chassis, and a seat for work around the automobile's exterior. The use of two separate work platforms instead of one is an added expense to the mechanic. When considering that many automotive shops work on several cars at the same time, the redundancy in work platforms greatly increases the cost necessary to work on the automobiles. Furthermore, the work area around the automobile quickly becomes congested considering that several tools are used on an automobile; such as computer aided diagnostics and general hand held tools, along with replacement parts lying around the work area. Accordingly, depending on the work activity, either the seat or the creeper is not being utilized and merely takes up space around the work area, further congesting the work area and making it more difficult for an orderly work place to be maintained by the mechanic.

U.S. Pat. No. 2,692,636 shows a combination automobile mechanic's creeper and stool. The creeper and stool disclosed by U.S. Pat. No. 2,692,636 utilizes coil spring members which connect a left and right platform to a center platform. The springs collapse the left and right platforms inward to convert the creeper into a stool. Lock bolts lock the device into the stool and creeper position. Consequently, this apparatus in its natural state can be used neither as a creeper nor a stool and the coil spring members in action create a potentially dangerous work environment.

U.S. Pat. No. 2,611,417 shows a combination mechanic's creeper and stool which has leg units. The creeper uses cumbersome finger tabs for retracting rods which release the leg units enabling the legs to be pivoted rendering the creeper into a stool. The unclasping of the finger tabs is very cumbersome and requires the mechanic's creeper to either be laid on its back or to be lifted thereby exposing the finger tabs. Furthermore, when the creeper is in a stool position, the legs of the stool abut the ground and do not provide the creeper with mobility.

U.S. Pat. No. Re.35,732 discloses a transformable mechanic's creeper having a "Z" configuration which has been successful in the marketplace wherein the wheels for mobility in a creeper mode are carried on the seat assembly. U.S. Pat. No. 5,707,067 discloses a transformable mechanic's creeper wherein a center section of the creeper platform pops up to make a seat. A shelf for tools and the like may be provided under the seat. While highly successful, the transformable creepers have been fairly limited in providing tool shelf space which is also mobile, particularly in the case of end platform/seat creepers.

Accordingly, it is an object of the present invention to provide a transformable mechanic's creeper which can be transformed between a horizontal mechanic's creeper and an upright seat having increased mobility in either position.

Additionally, it is an object of the present invention to provide for a transformable mechanic's creeper which is simple to use and easy to manufacture having increased mobile tool support space.

Furthermore, it is an object of the present invention to provide for a transformable mechanic's creeper which is transformable between a creeper and a seat wherein a roller frame is extended in a creeper position, and retracted in a seat position to provide mobility.

Additionally, it is an object of the present invention to provide for a transformable mechanic's creeper, which is transformable between a mechanic's creeper and a seat, which provides a utility shelf for tools and the like when utilizing the device in the seat position with the roller frame extended.

SUMMARY OF THE INVENTION

The above objectives are accomplished according to the invention by providing a transformable mechanic's creeper having an elongated creeper frame which includes a base assembly and a seat assembly interconnected by a connector frame assembly in the creeper frame. The connector frame assembly has a first pivot position in which the seat assembly is positioned generally in horizontal alignment with the base assembly for defining a creeper position. The base assembly and seat assembly are disposed near opposing ends of the elongated creeper frame when the elongated creeper frame is in the creeper position. Furthermore, the connector frame assembly has a second pivot position in which the seat assembly is positioned generally in vertical alignment and coextending with the base assembly such that the seat assembly and the base assembly support a worker in an upright seating position. An extendable roller frame assembly is slidably carried by the creeper frame assembly having a retracted configuration when the connector frame assembly is in the first pivotal position defining the seat position. The roller frame assembly has an extended configuration when the connector frame assembly is in the second pivotal position defining the creeper position wherein the roller frame assembly supports the seat assembly in the creeper position. At least one wheel carried by the roller frame assembly providing mobility for the creeper in the creeper position. The roller frame assembly includes at least one support carried by the frame, and a slide element which slides relative to the support on which the castor is carried. Preferrably, the roller frame assembly includes a plurality of supports carried by the base assembly, and a plurality of the slide element slidably carried by the supports wherein the slide elements may form a support for a tool tray and the like when the roller frame assembly is in the extended configuration and the creeper is in the seat position.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
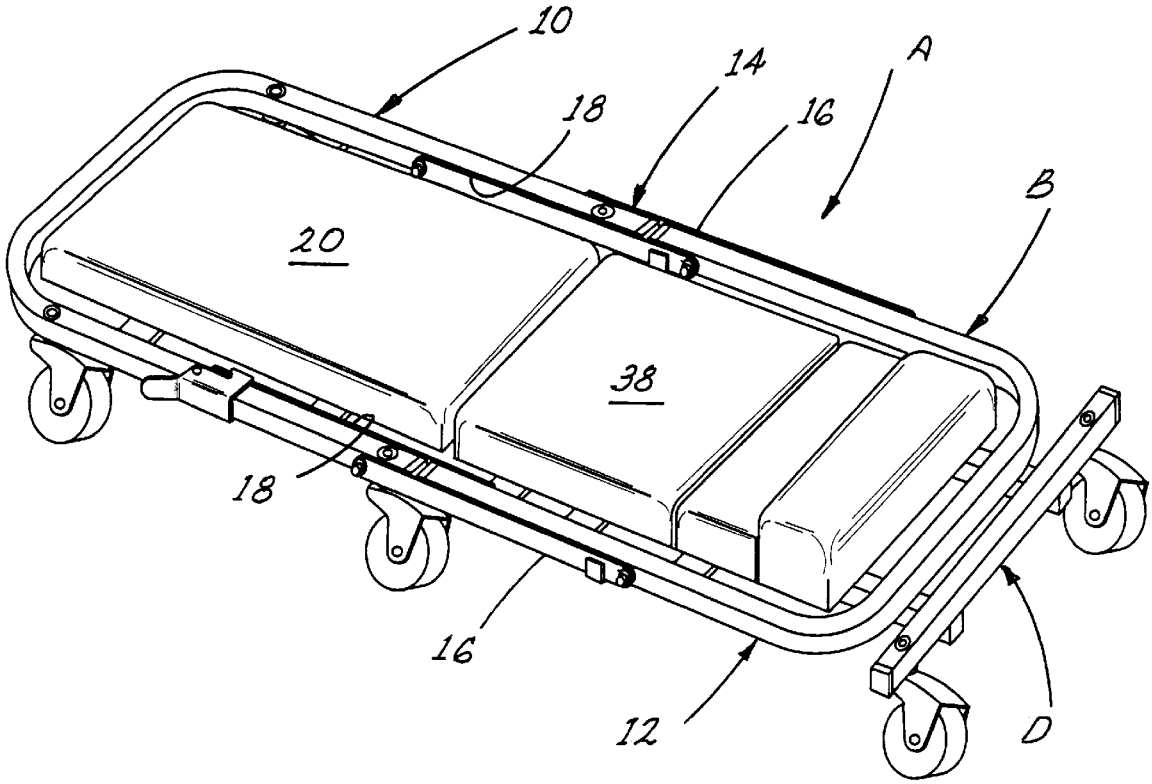
FIG. 1 is a perspective view of a transformable mechanic's creeper in a horizontal creeper position according to the invention.
Figure 2:
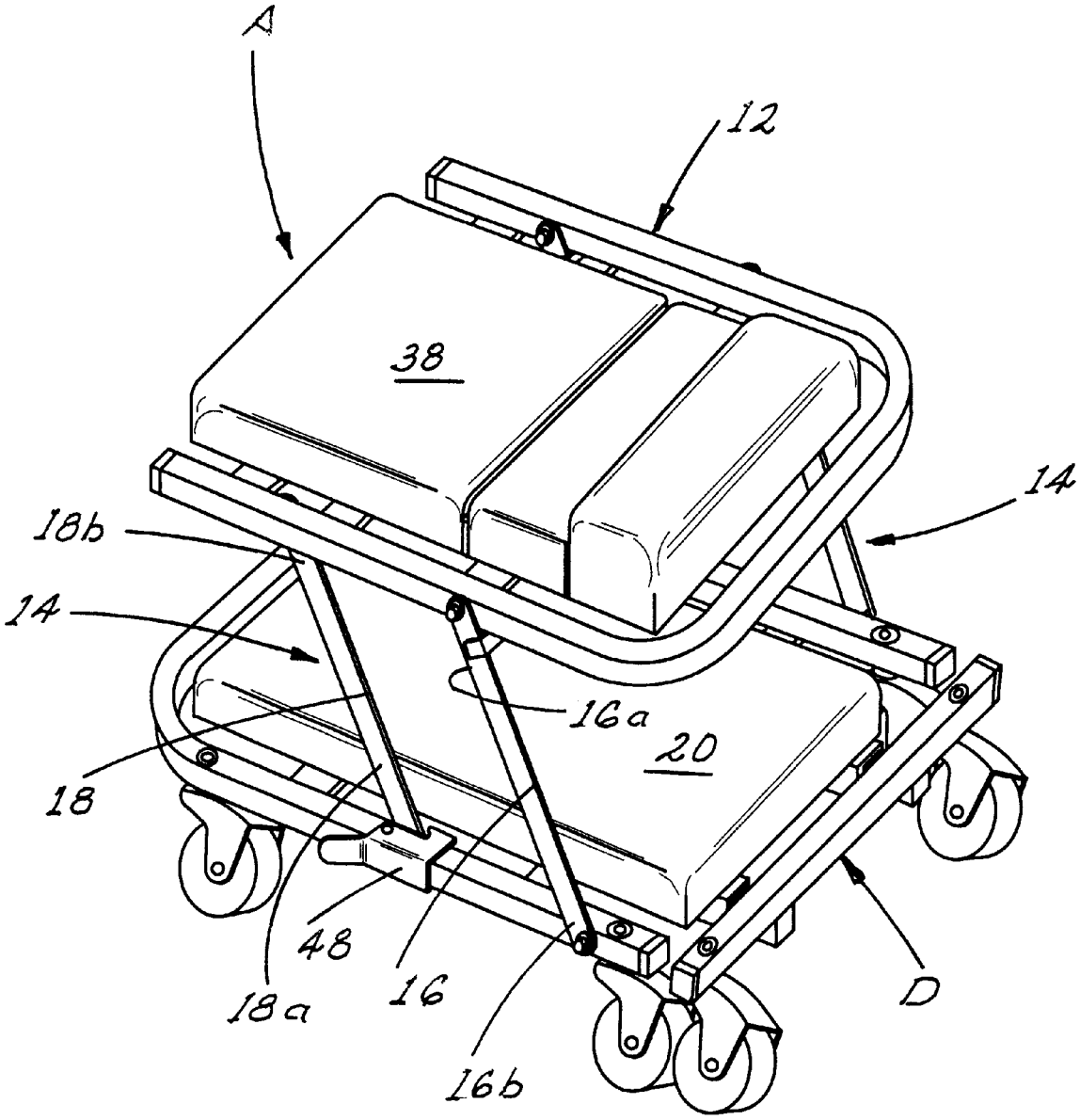
FIG. 2 is a perspective view of a transformable mechanic's creeper in a seat position according to the invention.

FIGS. 1 and 2 illustrate a transformable mechanic's creeper, designated generally A, for use by a worker working on an automobile or the like having an elongated creeper frame B in contact with a work floor. A base assembly 10 is included on one end of elongated creeper frame B and a seat assembly 12 is interconnected in elongated creeper frame B on an opposite end away from base assembly 10. A pivotal connector frame assembly, designated generally 14, interlinks base assembly 10 with seat assembly 12. In the preferred embodiment, connector frame assembly 14 includes a pair of interlinking connectors 16 and 18 which interlink seat assembly 12 with base assembly 10 on each side of the creeper frame. Interlinking connectors 16 and 18 each have an upper end 16*a* and 18*a* and lower end 16*b* and 18*b*, respectively. A base pad 20 is carried by base assembly 10 for supporting a worker in a supine position.

As shown in FIG. 2, base assembly 10 includes cross-braces 22 which transverse spaced base assembly frame legs 24 and 26. Seat assembly 12 includes spaced seat frame legs 30 and 32 which are connected by cross-braces 34. A seat pad 38 is affixed to braces 34.

Figure 3:
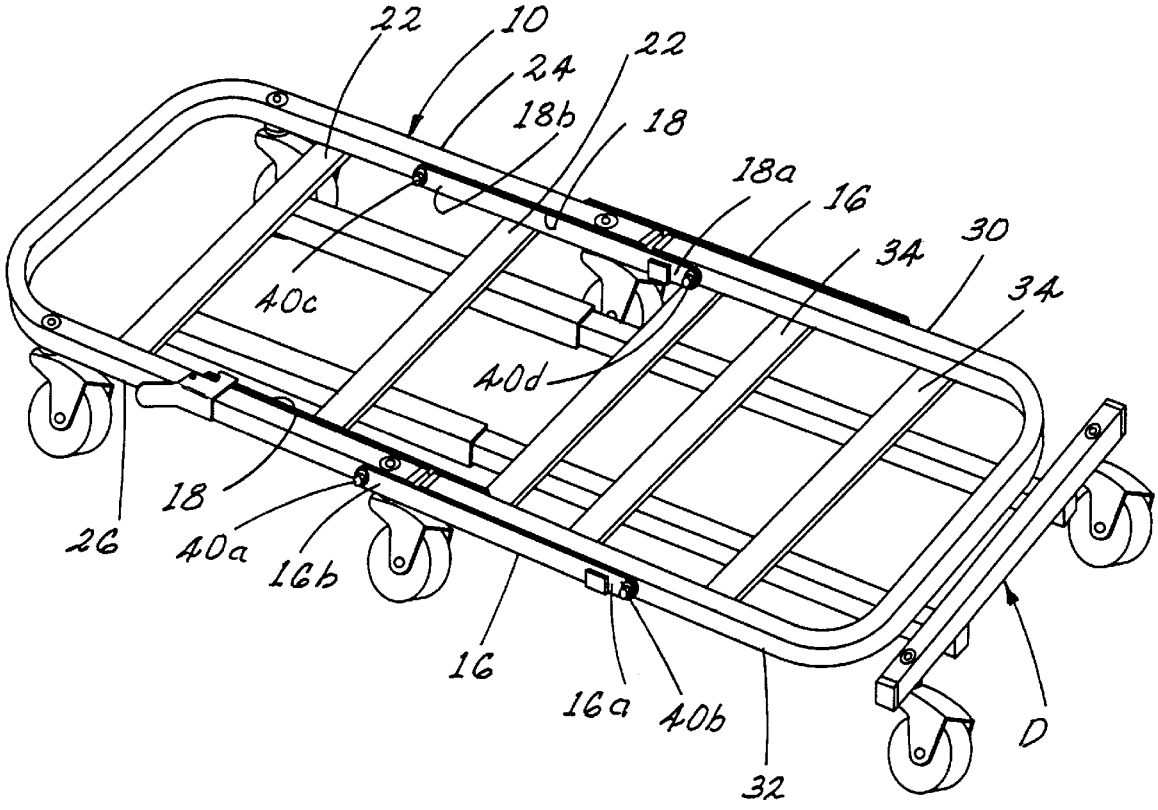
FIG. 3 is a perspective view of a transformable mechanic's creeper frame, and base assembly and seat assembly.

As can best be seen in FIG. 3, first interlinking connectors 16 are pivotally connected to base assembly legs 24 and 26 at first pivot points 40*a* and to seat assembly legs 30 and 32 at second pivot points 40*b*. Second interlinking connectors 18 are pivotally connected to base assembly legs 24, 26 at third pivot points 40*c* and to seat assembly legs 30, 32 at fourth pivot points 40*d*.

Figure 4:
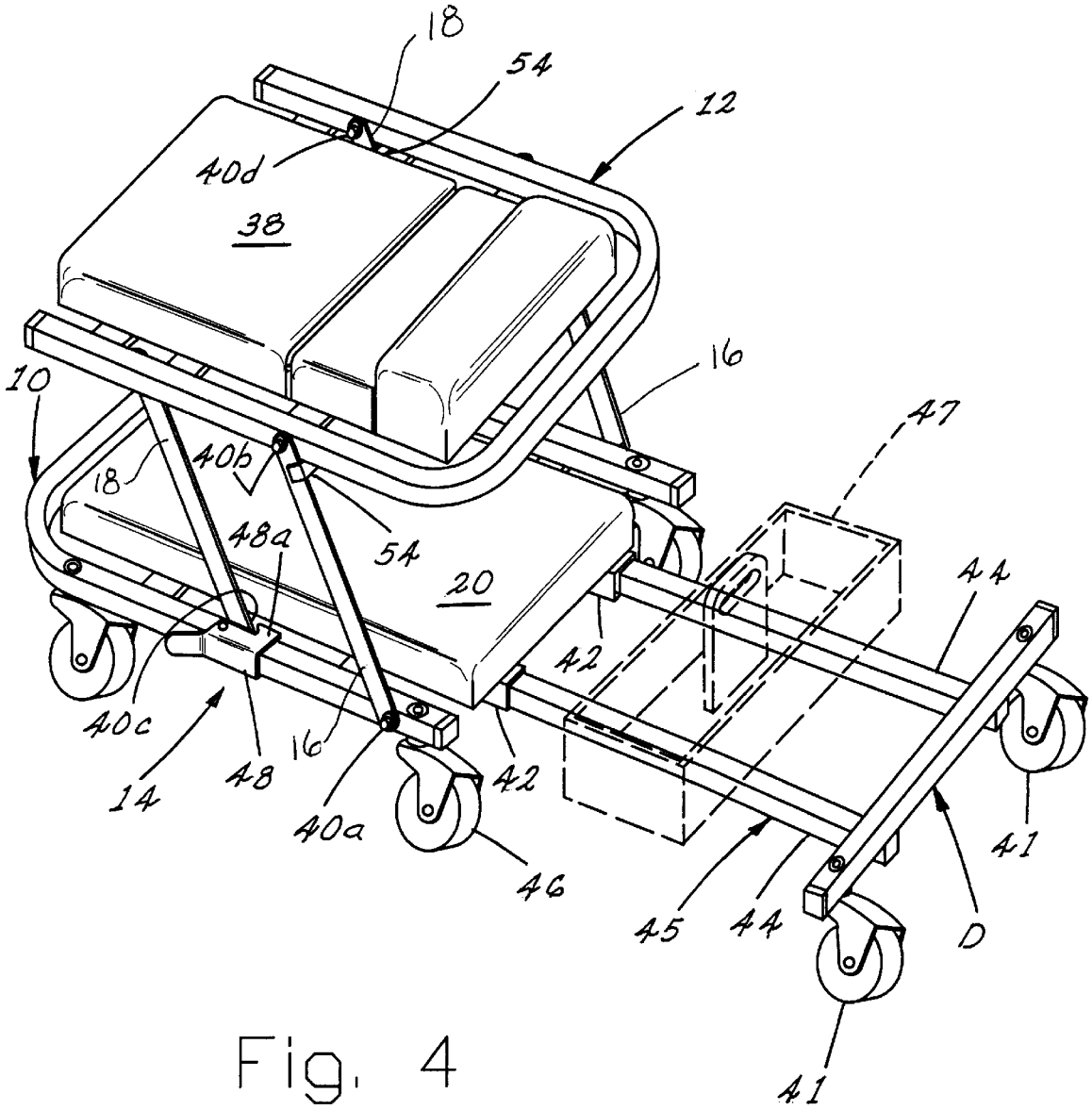
FIG. 4 is a perspective view of an extendable roller frame for a transformable mechanics creeper in accordance with the invention.
Figure 5:
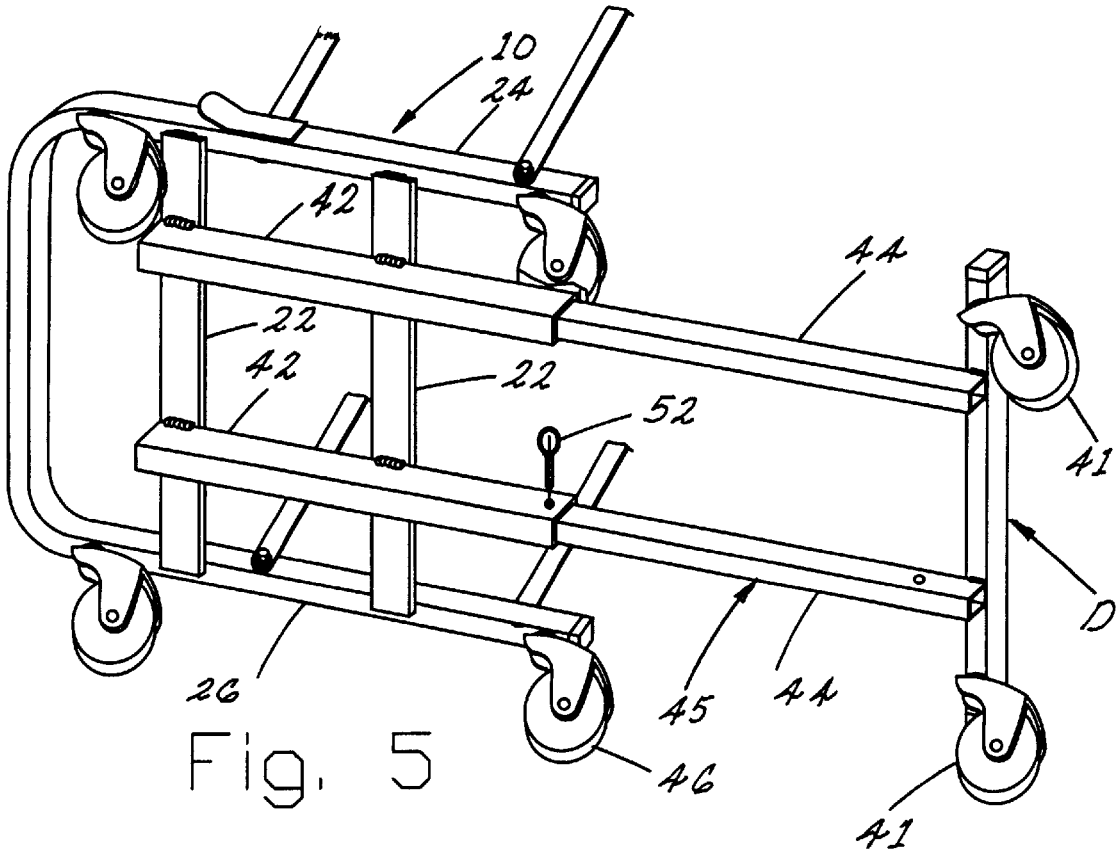
FIG. 5 is a bottom perspective view of a transformable mechanic's creeper with the roller frame of FIG. 4 in an extended configuration.
Figure 6:
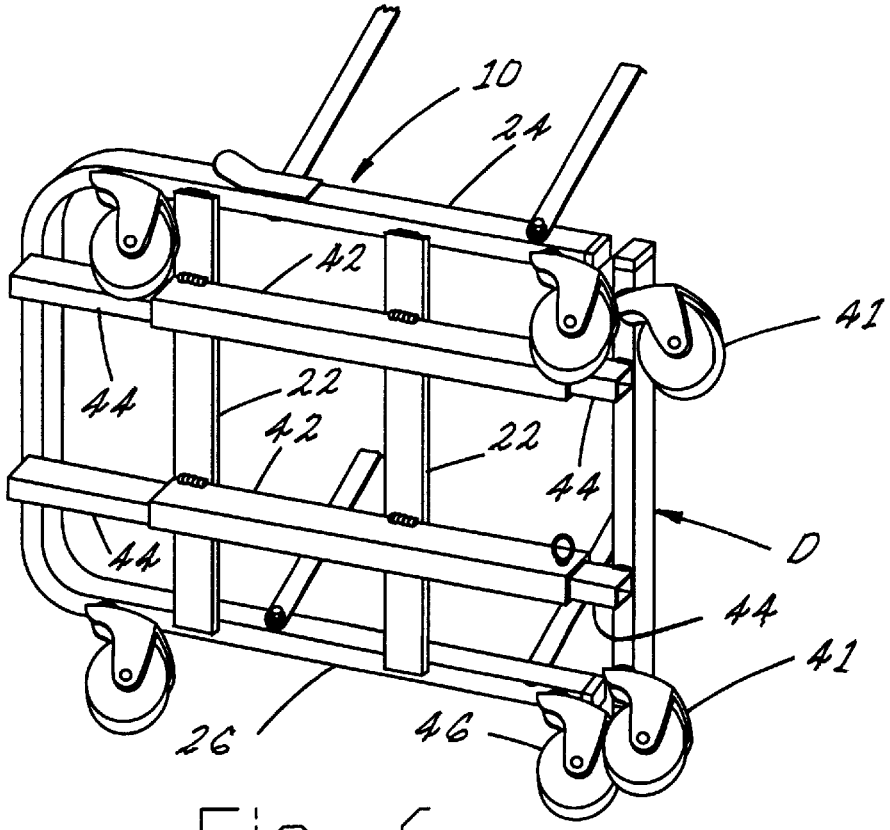
FIG. 6 is a bottom perspective view of a roller frame for a transformable mechanic's creeper in a retractec configuration to provide a seat position.

As can best be seen in FIGS. 3 and 4, a slidable roller frame assembly D is carried by creeper frame B, and specifically base assembly 10, having at least one wheel or castor 41. Roller frame assembly D has an extended configuration in which the roller frame assembly supports seat assembly 12 in the creeper position. When seat assembly 12 is in the seat position, the roller frame assembly is moved to a retracted configuration (FIG. 1) in which it cooperates with base assembly 10 to provide mobility for the creeper in the seat position. In the illustrated embodiment, roller frame assembly D includes at least one support 42 carried by base assembly 10, for example, by welding to base cross-braces 22. Preferrably, there is a pair of supports 42. Likewise, there is a pair of slide elements 44 which are slidably received in supports 42. Supports 42 and slide elements 44 are preferably rectangular tubular elements which telescope. A lock 43 is provided for locking support 42 and slide element 44 in the retracted and extended positions. Advantangeously, by using a pair of slide elements 44, a utility shelf 45 can be provided for supporting a mechanic's tray or tool box 47 in the seat position (FIG. 4). An adjustable lock or latch may be provided for fixing the relative longitudinal position of slide elements 44 and supports 42 to accommodate different size trays.

As can best be seen in FIGS. 1 and 3, connector frames 14 have a first pivot position in which seat assembly 12 is positioned generally in horizontal alignment with base assembly 10 to define a creeper position. In the creeper position, base assembly 10 and seat assembly 12 are disposed near opposing ends of elongated creeper frame B providing a horizontal platform. Seat assembly 12 and base assembly 10 in the creeper position provide elongated creeper frame B with sufficient length to support a worker lying in a supine position. In the first pivot position, seat 38 is aligned with base pad 20 providing a single horizontal platform which supports a worker lying in a supine position. A plurality of castors 46 depend from elongated creeper frame B. In the preferred embodiment, a plurality of castors 46*a* and 46*b* depend from base assembly 10 at opposing ends providing mechanic's creeper A with mobility in the creeper position. It is also possible that intermediate castors 46*b* can be eliminated when two castors 41 are employed on roller frame assembly D. In that case, creeper A has 4 casters instead of six.

As shown in FIGS. 1 and 2, mechanic's creeper A is transformable into a seat position from the creeper position. As shown in FIG. 4, connector frame 14 pivots counter-clockwise around pivot points 40*a* and 40*c* located at the end of base assembly frame legs 24 and 26 into a second pivot position. In the second pivot position, mechanic's creeper A is transformable into the seat position which consists of seat assembly 12, vertically above, and generally coextending with, base assembly 10. In the seating position, seat frame legs 30 and 32 of seat assembly 12 pivot around pivot points 40*b* and 40*d* respectively so that seat 38 is generally vertically aligned with base assembly 10 providing a horizontal seating platform. Utility shelf 45 may be extended or retracted in the seat position.

In order to maintain mechanic's creeper A in a seating position, at least one connector retention element 48 retains seat assembly 12 above base assembly 10. In a preferred embodiment, retention element 48 retains connector frame 14 upright by engaging and latching at lest one interlinking connector. Connector retention element 48 includes a pivotal latch 48*a* affixed to base leg 26 which prevents connector frame 14 from pivoting clockwise. In the seat position, the weight of the worker sitting on seat 38 forces seat assembly 12 to contact stops 54 of interlinking connector 14. At least one seat retention element in the form of a stop 54 is provided for maintaining seat assembly 12 horizontal. The weight of the worker forces interlinking connector 14 to pivot counter-clockwise around pivot points 40*a*–40*d* until stops 54 carried by connectors 16, 18 contacts seat assembly 12 (FIG. 4). With this design, the weight of the worker maintains mechanic's creeper A in the seat position. Connector retention element 48 then latches the creeper in the seat position. It is to be understood that other arrangements for maintaining the seat position may be had such as stops carried on the base or seat instead of the connectors, or on different connectors.

In operation, mechanic's creeper A is easily transformable from a horizontal creeper to a vertical seat. To transform creeper A from a horizontal creeper position into a seat position, seat assembly 12 is lifted pivoting interlinking connector 14 counterclockwise around pivot points 40*a*–40*d*. Seat assembly 12 is positioned in general vertical alignment with base assembly 10 as connector retention element 48 engages connector 18. Seat assembly 12 pivots until seat assembly 12 contacts stops 54. To transform mechanic's creeper A from a seating position into a horizontal creeper, retention element 48 is released and seat assembly 12 is pulled forward pivoting interlinking connector 14 clockwise around pivot points 40*a* and 40*c*. Seat assembly 12 is lowered until the assembly rests on roller frame assembly D and castors 46 touch ground.

Thus, it can be seen than an advantageous construction can be had for a transformable mechanic's creeper according to the invention where the mechanic's creeper can readily be transformed between a horizontal creeper and a vertical seat. The pivoting interlinking connector provides the mechanic's creeper with sufficient length for a horizontal creeper and sufficient height for the vertical seat. In the seat position increased roller support is provided while making increased shelf space available.

While a preferred embodiment of the invention has been described using specific terms, such description is for illustrative purposes only, and it is to be understood that changes and variations may be made without departing from the spirit or scope of the following claims.

What is claimed is:

1. A transformable mechanic's creeper for use by a worker, said creeper transforming between a horizontal position for supporting said worker working underneath said automobile in a supine position and a seat position for supporting said worker working in an upright seating position, said creeper comprising:

an elongated creeper frame;

a base assembly included in said elongated creeper frame;

a seat assembly interconnected in said elongated creeper frame with said base assembly;

a plurality of castors carried by said creeper frame, said castors supporting said elongated creeper frame on a work floor providing said elongated creeper frame with mobility;

at least one interlinking connector interconnecting said seat assembly and base assembly on opposing sides thereof;

each said interlinking connector having a first end pivotally connected to said base assembly, and a second end pivotally connected to said seat assembly;

said interlinking connector having a first pivot position in which said seat assembly is positioned generally in horizontal alignment with said base assembly to define a creeper position;

said interlinking connector having a second pivot position in which said seat assembly is positioned generally in vertical alignment with said base assembly to define a seat position wherein said seat assembly and said base assembly support said worker seated; and an extendable roller frame assembly slidably carried by said frame, said roller frame assembly having a retracted configuration when said interlinking connector is in said first pivotal position defining said seat position, said roller frame assembly having an extended configuration when said interlinking connector is in said second pivotal position defining said creeper position wherein said roller frame assembly supports said seat assembly in said creeper position, and at least one wheel carried by said roller frame assembly providing mobility for said creeper in said creeper position.

2. The mechanic's creeper of claim 1 wherein said seat assembly is longitudinally spaced from said base assembly when said interlinking connector is in said first pivot position providing said elongated creeper frame with sufficient length to support said worker lying in a supine position.

3. The mechanic's creeper of claim 1 wherein said roller frame assembly includes horizontal slide elements which form a utility shelf when said seat assembly is in said seat position and said roller frame is maintained in said extended configuration.

4. The mechanic's creeper of claim 1 wherein said roller frame assembly includes at least one support carried by said frame, and a slide element which slides relative to said support on which at least one castor is carried.

5. The mechanic's creeper of claim 4 wherein said roller frame assembly includes a plurality of supports carried by a base assembly, and a plurality of said slide element slidably carried by said supports wherein said slide elements define a support for a tool tray and the like when said roller frame assembly is in said configuration and said creeper is in said seat position.

6. The mechanic's creeper of claim 1 wherein said interlinking connector includes a pair of interlinking connectors pivotally connected to said seat assembly and base assembly on each opposing side of said creeper frame.

7. The mechanic's creeper of claim 1 including at least one retention element carried by said elongated creeper frame retaining said seat and base assembly vertical in said second pivot position to maintain said seating position.

8. The mechanic's creeper of claim 1 including a connector retention element, and a seat retention element maintaining said seat assembly generally parallel above said base assembly when said interlinking connector is in said second pivot position.

9. The mechanic's creeper of claim 1 wherein said elongated creeper frame includes a first plurality of stops carried by one of said interlinking connector and said base assembly, said first plurality of stops engaging the other of said base assembly and interlinking connector to maintain said interlinking connector above said base assembly.

10. The mechanic's creeper of claim 1 wherein said elongated creeper frame includes a second plurality of stops carried by one of said interlinking connector and said seat assembly, said second plurality of stops engaging the other of said seat assembly and interlinking connector to maintain said seat assembly above said base assembly.

11. A transformable mechanic's creeper for use by a worker working on an automobile or the like, said mechanic's creeper transforming between a horizontal position for supporting said worker working underneath said automobile in a supine position and transforming into a seat position for supporting said worker working in an upright position, said mechanic's creeper comprising:

an elongated creeper frame;

a base assembly included in said creeper frame;

a seat assembly interconnected in said creeper frame with said base assembly;

a connector frame assembly interconnecting said base assembly and seat assembly;

a creeper position defined by said base assembly and seat assembly being positioned by said connector frame assembly generally in horizontal alignment to support a mechanic in a supine position;

a seat position defined by said seat assembly being positioned by said connector frame assembly generally in vertical alignment with said base assembly wherein said seat assembly coextends generally over said base assembly to support said worker seated on said seat assembly;

a plurality of castors depending from said elongated creeper frame for mobility; and an extendable roller frame assembly slidably carried by said creeper frame, said roller frame assembly having a retracted configuration when said connector frame is in said seat position, said roller frame assembly having an extended configuration when said connector frame is in said creeper position wherein said roller frame assembly supports said seat assembly in said creeper position, and at least one wheel carried by said roller frame assembly providing mobility for said creeper in said creeper position.

12. The mechanic's creeper of claim 11 wherein said seat assembly is longitudinally spaced from said base assembly when said interlinking connector is in said first pivot position providing said elongated creeper frame with sufficient length to support said worker lying in a supine position.

13. The mechanic's creeper of claim 11 wherein said roller frame assembly includes horizontal slide elements which form a utility shelf when said seat assembly is in said seat position and said roller frame is maintained in said extended configuration.

14. The mechanic's creeper of claim 11 wherein said roller frame assembly includes at least one support carried by said frame, and at least one slide element which slides relative to said support on which said at least one castor is carried.

15. The mechanic's creeper of claim 14 wherein said roller frame assembly includes a plurality of supports carried by a base assembly, and a plurality of said slide element slidably carried by said supports wherein said slide elements may define a support for a tool tray and the like when said roller frame assembly is in said extended configuration and said creeper is in said seat position.

16. The mechanic's creeper of claim 11 wherein said connector frame includes a pair of interlinking connectors pivotally connected to said seat assembly and base assembly on each opposing side of said creeper frame.

17. The mechanic's creeper of claim 11 including at least one retention element carried by said elongated creeper frame retaining said seat and base assembly vertical in said second pivot position to maintain said seating position.

* * * * *